US005986216A

United States Patent [19]

Krause

[11] Patent Number: 5,986,216

[45] Date of Patent: Nov. 16, 1999

[54] REINFORCED INSULATOR

[75] Inventor: John Allen Krause, Eastlake, Ohio

[73] Assignee: Hubbell Incorporated, Orange, Conn.

[21] Appl. No.: 08/985,956

[22] Filed: Dec. 5, 1997

[51] Int. Cl.[6] ..... H01B 17/06

[52] U.S. Cl. ..... 174/179; 174/188; 174/195; 174/204; 174/209

[58] Field of Search ..... 174/80, 140 S, 174/140 R, 141 R, 150, 155, 179, 176, 178, 188, 189, 195, 196, 204, 209, 75 R, 169, 177; 361/118, 126, 127

[56] References Cited

U.S. PATENT DOCUMENTS

| | | | |
|---|---|---|---|
| D. 202,785 | 11/1965 | Vose . | |
| D. 219,590 | 12/1970 | Vose . | |
| 566,045 | 8/1896 | Whitaker et al. . | |
| 735,212 | 8/1903 | Converse . | |
| 756,026 | 3/1904 | Kinsley | 174/155 |
| 1,197,660 | 9/1916 | Peirce, Jr. | 174/204 |
| 1,426,789 | 8/1922 | Steinberger . | |
| 1,446,593 | 2/1923 | Sonneburn | 174/140 S |
| 1,709,477 | 4/1929 | Kyle . | |
| 2,234,737 | 3/1941 | Mace . | |
| 2,266,400 | 12/1941 | Reed . | |
| 3,110,759 | 11/1963 | Moussou . | |
| 3,483,314 | 12/1969 | Harmon . | |
| 3,531,580 | 9/1970 | Foster . | |
| 3,898,372 | 8/1975 | Kalb . | |
| 4,177,322 | 12/1979 | Homan et al. . | |
| 4,243,628 | 1/1981 | Herold . | |
| 4,246,696 | 1/1981 | Bauer et al. . | |
| 4,373,113 | 2/1983 | Winkler et al. . | |
| 4,440,975 | 4/1984 | Kaczerginski . | |
| 4,476,081 | 10/1984 | Kaczerginski et al. . | |
| 4,701,577 | 10/1987 | Bourrieres . | |
| 4,702,873 | 10/1987 | Kaczerginski . | |
| 4,714,800 | 12/1987 | Atkins et al. . | |
| 4,749,824 | 6/1988 | Orbeck . | |
| 4,760,640 | 8/1988 | Lawrence | 29/760 |
| 4,940,857 | 7/1990 | Giroux . | |
| 4,973,798 | 11/1990 | Parraud et al. . | |
| 5,147,984 | 9/1992 | Mazeika et al. . | |
| 5,159,158 | 10/1992 | Sakich et al. | 174/179 |
| 5,214,249 | 5/1993 | Goch et al. | 174/179 |
| 5,220,134 | 6/1993 | Novel et al. . | |
| 5,233,132 | 8/1993 | Soucille . | |
| 5,298,301 | 3/1994 | Midgley et al. . | |
| 5,336,852 | 8/1994 | Goch et al. | 174/176 |
| 5,374,789 | 12/1994 | Bernstorf | 174/188 |
| 5,389,742 | 2/1995 | Clabburn et al. | 174/209 |
| 5,406,033 | 4/1995 | Pazdirek . | |

FOREIGN PATENT DOCUMENTS

| | | | |
|---|---|---|---|
| 1932949 | 1/1971 | Germany . | |
| 8301707 | 5/1983 | WIPO | 174/179 |

*Primary Examiner*—Kristine Kincaid
*Assistant Examiner*—Dhiru R Patel
*Attorney, Agent, or Firm*—Jerry M. Presson; David L. Tarnoff; Mark S. Bicks

[57] ABSTRACT

A reinforced electrical insulator has a load sustaining mechanical core with a pair of attachment members located at its longitudinal ends. One of the attachment members extends longitudinally into the mechanical core to provide reinforcement to the mechanical core. The mechanical core member is constructed of a rigid, dielectric material with a first end section, a second end section, and a center section. A plurality of weathersheds extending outwardly from the center section of core member in a substantially radial direction relative to the longitudinal axis. The first and second end sections having maximum widths which are larger than the maximum width of the center section. The attachment members have inner portions embedded within the end sections of the core and outer portions extending outwardly from the end sections of the core. One of the attachment members has its inner portion embedded within the center section of the core and its outer portion provided with first and second posts extending outwardly from the core. The first and second posts have their centers spaced apart by a distance which is greater than the maximum width the second inner portion. In the preferred embodiment, the posts are threaded with their centers lying on a 2.25 inch or 3 inch circle.

30 Claims, 5 Drawing Sheets

FIG. 9
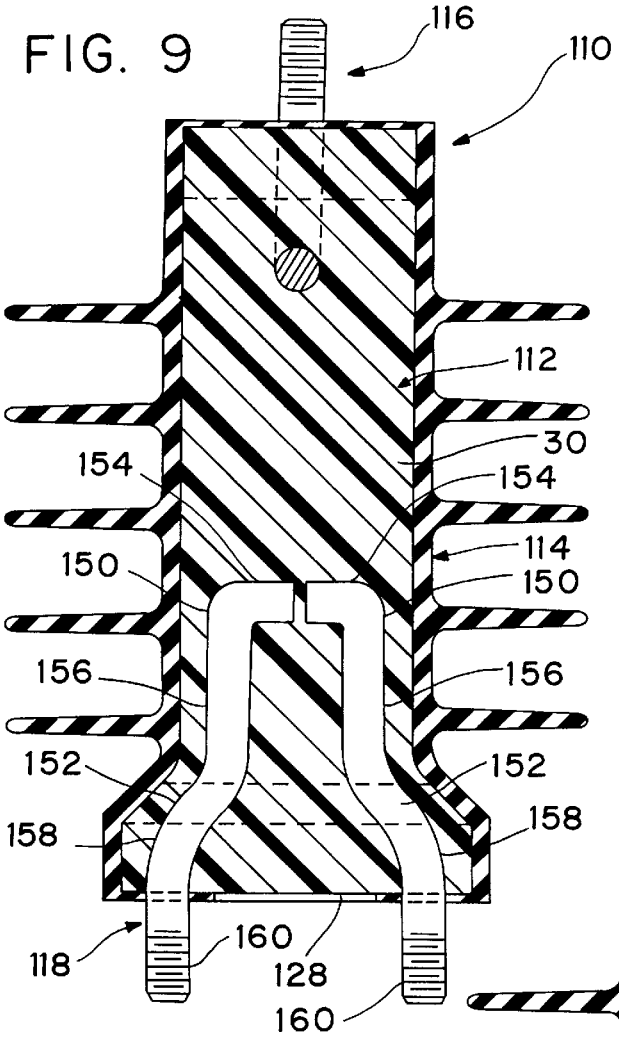
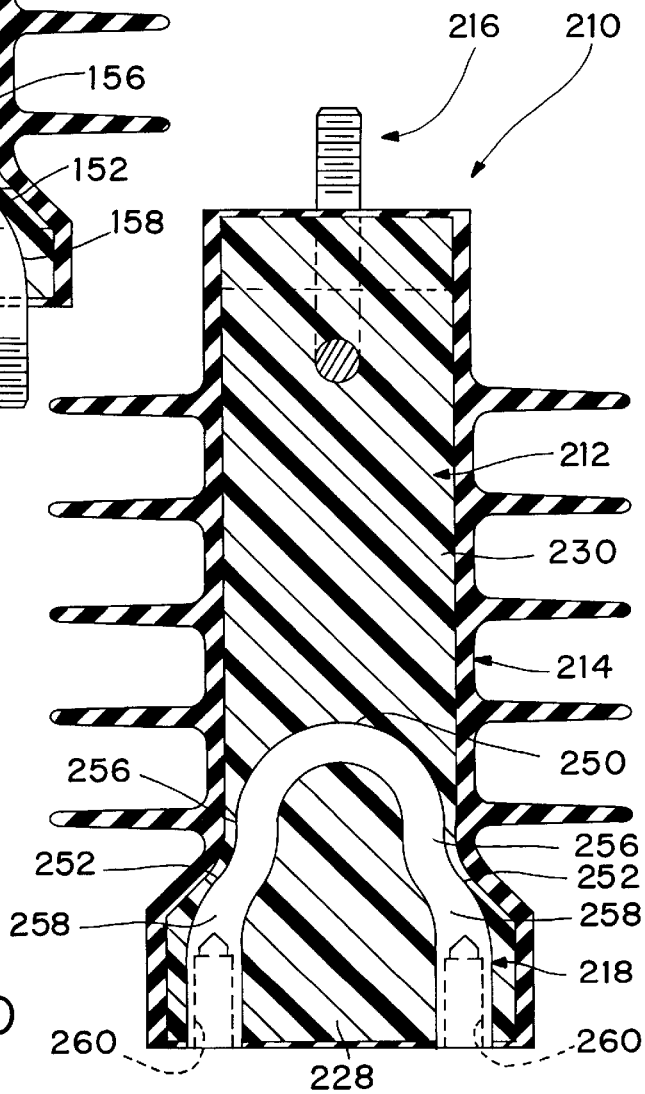
FIG. 10

REINFORCED INSULATOR

FIELD OF THE INVENTION

The present invention generally relates to an electrical insulator which is mounted in a cantilever manner, i.e., one end of the insulator is mounted to a support, while the other is coupled to an electrical device or conductor. More specifically, the present invention relates to a reinforced insulator.

BACKGROUND OF THE INVENTION

Electrical insulators are used to support electrical conductors and/or electrical devices to prevent the loss of electric charge or current therefrom. A typical insulator is constructed from a material which has a very high resistance to electric current so that the electric current does not substantially flow therethrough.

Insulators may be connected to and carried by power lines and/or supports in a variety of ways. For example, high voltage suspension insulators are used to suspend power transmission lines from overhead supports on poles and towers. Boulder suspension insulators are made of strings of porcelain insulators having a size and shape required of that material to provide the necessary mechanical strength, dielectric strength and creapage distance. To provide the necessary mechanical and electrical characteristics, porcelain insulators are typically quite heavy. Moreover, such porcelain insulators are expensive and brittle. Therefore, such porcelain insulators are subject to damage during shipment and insulation.

Overhead electric power lines, wires or conductors are supported by poles or towers which may be constructed of wood, metal or other common materials. The overhead power lines are mounted on poles or towers by insulators which are maintained in a predetermined orientation by an insulator.

These insulators were, in the past, typically constructed of ceramic material such as porcelain, and a variety of shapes and/or designs depending upon the necessary mechanical strength, dielectric strength and leakage distance. However, the use of porcelain for insulators has several disadvantages. For example, porcelain insulators are often very heavy to provide the necessary mechanical and electrical characteristics. Moreover, such porcelain insulators are typically expensive to install and require strong supporting structure for supporting the insulator to the pole or tower. Additionally, porcelain insulators are brittle which makes them subject to being damaged during shipping and installation of the insulators. Porcelain insulators are susceptible to vandalism damage.

Accordingly, in recent years, newer insulators have been developed which include a fiberglass reinforced polymer core and an external protective housing forming annular flanges or webbed weathersheds. The weathershed housing or sheath is usually constructed of an elastomeric or an epoxy material. Elastomer or epoxy sheaths are designed to protect the fiberglass reinforced rods from weather and electrical activity. Weather and electrical activity degrade the mechanical strength of the fiberglass reinforced rod. The weathersheds on the housing intercept water flow down the insulator and increase the distance along the surface of the insulator for better electrical performance in wet or contaminated conditions.

Examples of some prior electrical devices are disclosed in U.S. Pat. No. 1,426,789 to Steinberger; U.S. Pat. No. 1,709, 477 to Kyle; U.S. Pat. No. 3,110,759 to Moussou; U.S. Pat. No. 3,483,314 to Harmon; U.S. Pat. No. 3,531,580 to Foster; U.S. Pat. No. 4,243,628 to Herold; U.S. Pat. No. 4,440,975 to Kaczerginski, U.S. Pat. No. 4,476,081 to Kaczerginski et al; U.S. Pat. No. 4,702,873 to Kaczerginski; U.S. Pat. No. 4,714,800 to Atkins et al; U.S. Pat. No. 4,749,824 to Orbeck; U.S. Pat. No. 4,940,857 to Giroux; U.S. Pat. No. 5,220,134 to Novel et al; U.S. Pat. No. 5,147,984 to Mazeika et al; U.S. Pat. No. 5,233,132 to Soucille; U.S. Pat. No. 5,298,301 to Midgley et al; U.S. Pat. No. 5,406,033 to Pazdirek.

In view of the above, there exists a need for an electrical insulator which is reinforced to accommodate the strain from the electrical device or conductor attached to its free end. This invention addresses this need in the prior art as well as other needs which will become apparent to those skilled in the art from this disclosure.

SUMMARY OF THE INVENTION

An object of the present invention is to provide an electrical reinforced insulator having an end fitting which extends longitudinally into the core along the area subjected to a strain from an electrical device or conductor.

A further object of the present invention is to provide an insulator which is simple to manufacture using relatively conventional molding or machining methods.

Still another object of the present invention is to provide an electrical insulator which is light weight and inexpensive to manufacture.

Another object of the present invention is to provide an electrical insulator which is easy to handle and install.

The foregoing objects are basically attained by a reinforced electrical insulator, comprising: an elongated core member constructed of a rigid, dielectric material, the core member having a first end section, a second end section, and a center section with a first maximum width located between the first and second ends and extending longitudinally along a longitudinal axis, the first and second end sections having second and third maximum widths which are larger than the first maximum width of the center section; a plurality of weathersheds extending outwardly from the center section of core member in a substantially radial direction relative to the longitudinal axis; a first attachment member having a first inner portion embedded within the first end section of the core member and a first outer portion extending outwardly from the first end section of the core member; and a second attachment member having a second inner portion embedded within the center section of the core member and a second outer portion coupled to the second inner portion and extending outwardly from the second end section of the core member, the second inner portion having a fourth maximum width, the second outer portion having a fifth maximum width which is greater than the first maximum width of the center section.

Other objects, advantages and salient features of the present invention will become apparent to those skilled in the art from the following detailed description, which, taken in conjunction with the annexed drawings, discloses preferred embodiments of the present invention.

BRIEF DESCRIPTION OF THE DRAWINGS

Referring to the attached drawings which form a part of this original disclosure:

FIG. 9 is a longitudinal cross-sectional view of a reinforced electrical insulator in accordance with a second embodiment of the present invention, but with its second or lower attachment member illustrated in elevation; and FIG. 10 is a longitudinal cross-sectional view of a reinforced electrical insulator in accordance with a third embodiment of the present invention, but with its second or lower attachment member illustrated in elevation.

DETAILED DESCRIPTION OF THE PREFERRED EMBODIMENT

Figure 1:
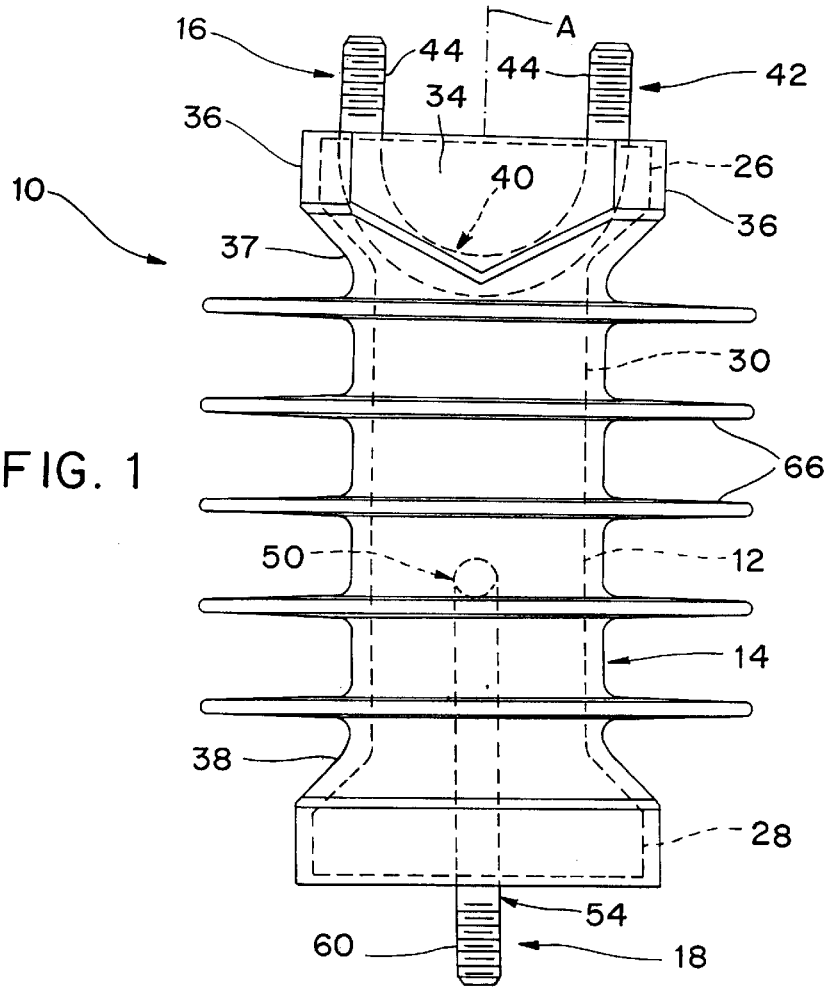
FIG. 1 is a front elevational view of a reinforced electrical insulator in accordance with the present invention.

Referring initially to FIG. 1, a reinforced electrical insulator 10 in accordance with the present invention is illustrated. Basically, insulator 10 includes an elongated load sustaining mechanical core 12 with a dielectric sheath 14 overlying mechanical core 12 to protect mechanical core 12 from weather, ultra-violet rays and electrical surface discharges, and first and second attachment members 16 and 18. Reinforced electrical insulator 10 is especially adapted to be mounted in a cantilever fashion, e.g., on a cross-arm or support member of a utility pole or tower (not shown) by second or lower attachment member 18 with its other end supporting an electrical device or conductor (not shown) via first or upper attachment member 18. More specifically, upper attachment member 18 of reinforced electrical insulator 10 is particularly adapted to have a part of a switching device (not shown) coupled thereto in a conventional manner. Reinforced electrical insulator 10 is designed such that less expensive materials can be used in its construction. In particular, mechanical core 12 can be shaped and formed of a material having less strength than prior art insulators due to the use of attachment member 18 which reinforces core 12.

Mechanical core 12 is constructed of a hard, rigid material which is capable of supporting an electrical device or conductor. The material used for mechanical core 12 can be any dielectric material such as an epoxy or polyester, which meets the mechanical characteristics requirements of the intended use of insulator 10 in view of the reinforcements. For example, some suitable materials for mechanical core 12 includes various types of reinforced or non-reinforced epoxies, polyesters, vinyl esters or other plastic materials. Preferably, core 12 is a plastic polymer which can be either a thermoplastic material or a thermosetting material. Exemplary materials are polypropylene, polyethylene, epoxy and rubber plastic blends. These plastic polymers can be mechanically reinforced with fiberglass or other reinforcing materials and can be filled with substances such as hydrated alumina (aluminum trihydrate ATH) to enhance electrical performance.

One example of a suitable polymer plastic for mechanical core 12 is a composite of the following:

| | Percent By Weight |
|---|---|
| Polyethylene | 15–80 |
| Aluminum Trihydrate | 0–75 |
| Fiberglass | 0–45 |
| Kevlar-Aramid Fiber | 0–5 |
| Silicone Rubber | 0–60 |
| Ethylene-Propylene Rubber or Ethylene-Propylene Diene Rubber | 0–25 |
| Silicone Dioxide | 0–10 |
| Titanium Dioxide | 0–10 |
| Compatiblizers, Antioxidants | 0.1–10 |
| Coagents, Stabilizers and Miscellaneous Additives | |

| | Percent By Weight |
|---|---|
| Polyethylene | 0–80 |
| Aluminum Trihydrate (Flame Retardants) | 0–80 |
| Silicone Rubber | 0–60 |
| Ethylene-Propylene Rubber or Ethylene-Propylene Diene Rubber and/or Ethylene-Vinyl Acetate Rubber/Plastic | 0–80 |
| Silicone Dioxide | 0–40 |
| Titanium Dioxide | 0–40 |
| Compatiblizers, Antioxidants | 0.1–20 |
| Coagents, Peroxides, Coupling Agents, Stabilizers and Miscellaneous Additives | |

In the above examples, the polyethylene, ethylene-propylene rubber and ethylene-propylene diene rubber can be traditional or metallocene catalyzed.

Mechanical core 12 can be produced by conventional molding and/or machining methods which are well-known in the art. Thus, these molding and machining methods for producing mechanical core 12 will not be discussed or illustrated in detail herein. Of course, it will be apparent to those skilled in the art from this disclosure that molding methods such as compression, injection or transfer can be used to construct mechanical core 12.

Mechanical core 12 has a first or upper end section 26, a second or lower end section 28, and a center section 30 located between first and second end sections 26 and 28. Mechanical core 12 is preferably an elongated insulating member with its longitudinal axis A extending between first and second end sections 26 and 28. First or upper longitudinal end section 26 has first attachment member 16 extending outwardly therefrom, while second or lower longitudinal end section 28 has second attachment member 18 extending outwardly therefrom. First or upper attachment member 16 is designed to be attached to an electrical device or conductor, while second attachment member 18 is designed to be attached to a support member such as a cross-arm of a tower or pole.

Figure 5:
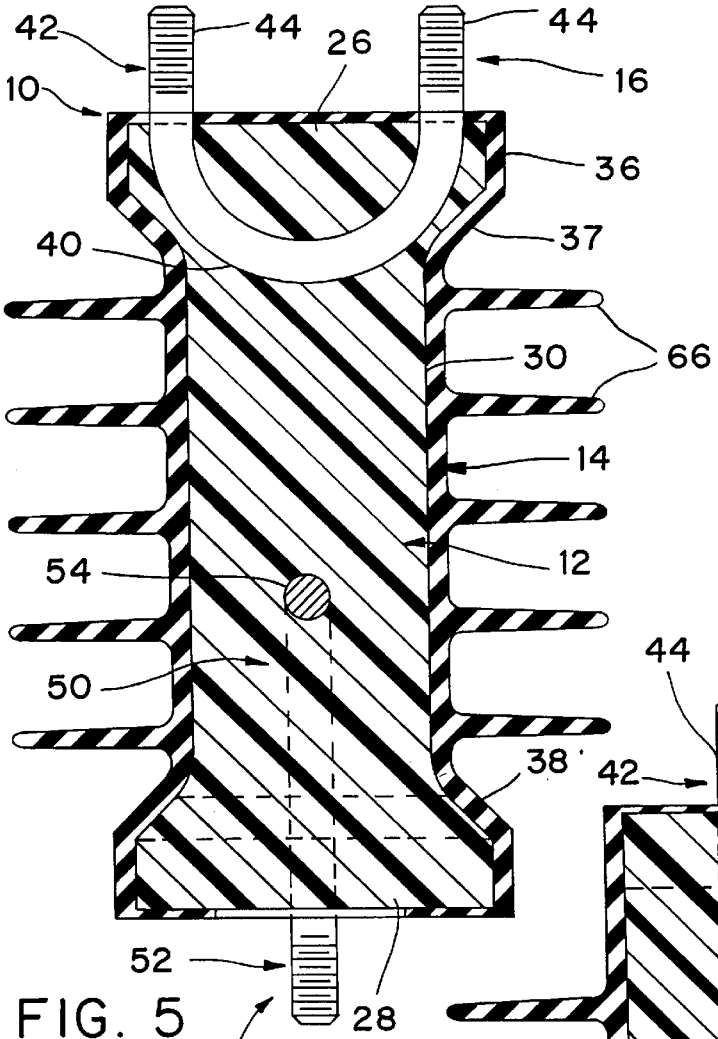
FIG. 5 is a longitudinal cross-sectional view of the reinforced electrical insulator illustrated in FIGS. 1–4 as taken along section line 5–5 of FIG. 1, but with the upper attachment member or U-bolt shown in elevation.
Figure 6:
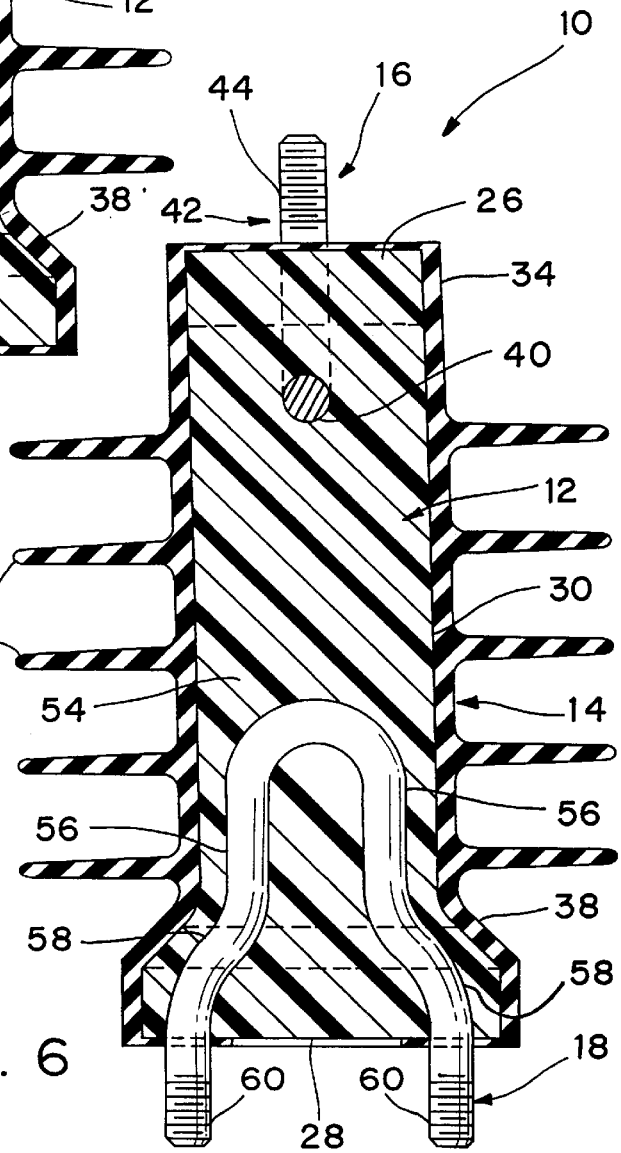
FIG. 6 is a longitudinal cross-sectional view of the reinforced electrical insulator illustrated in FIGS. 1–5 as seen along section line 6–6 of FIG. 2, but with the second or lower attachment member illustrated in elevation.

As best seen in FIGS. 1 and 5, first and second end sections 26 and 28 are enlarged relative to center section 30 for accommodating attachment members 16 and 18, respectively. Center section 30, on the other hand, has a smaller diameter or width than end sections 26 and 28 to minimize the amount of material needed to construct mechanical core 12. In other words, the maximum width or diameter of center section 30 is smaller than the maximum diameter or widths of end sections 26 and 28. Accordingly, end sections 26 and 28 has to be configured larger than center section 30 to accommodate attachment members 16 and 18, respectively. Center section 30, on the other hand, does not need a width as large as end sections 26 and 28. Thus, center section 30 can be configured to minimize costs but yet provided with a width having sufficient electrical resistance and support.

Figure 3:
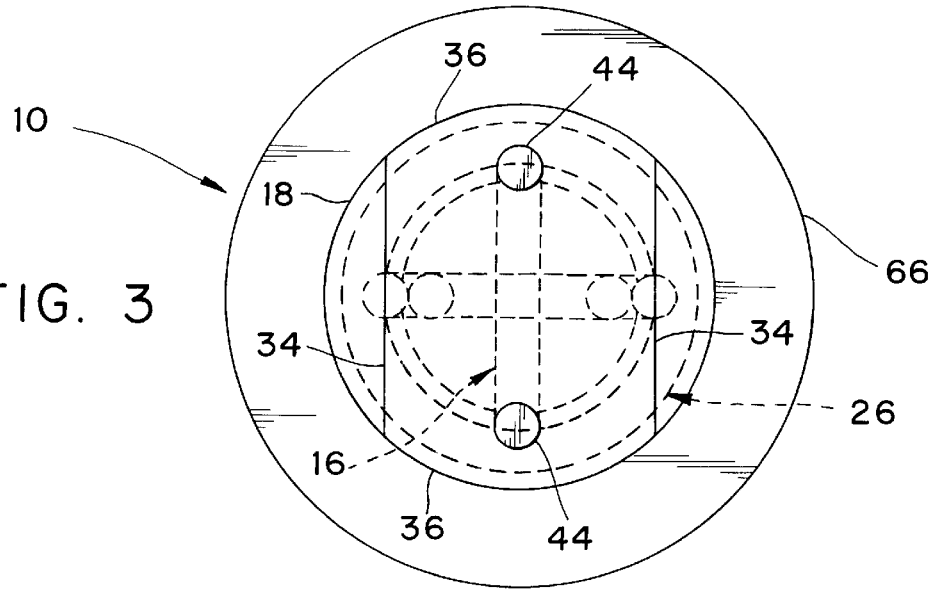
FIG. 3 is a top plan view of the electrical insulator illustrated in FIG. 1, but with the insulator rotated 90° about its longitudinal axis.
Figure 4:
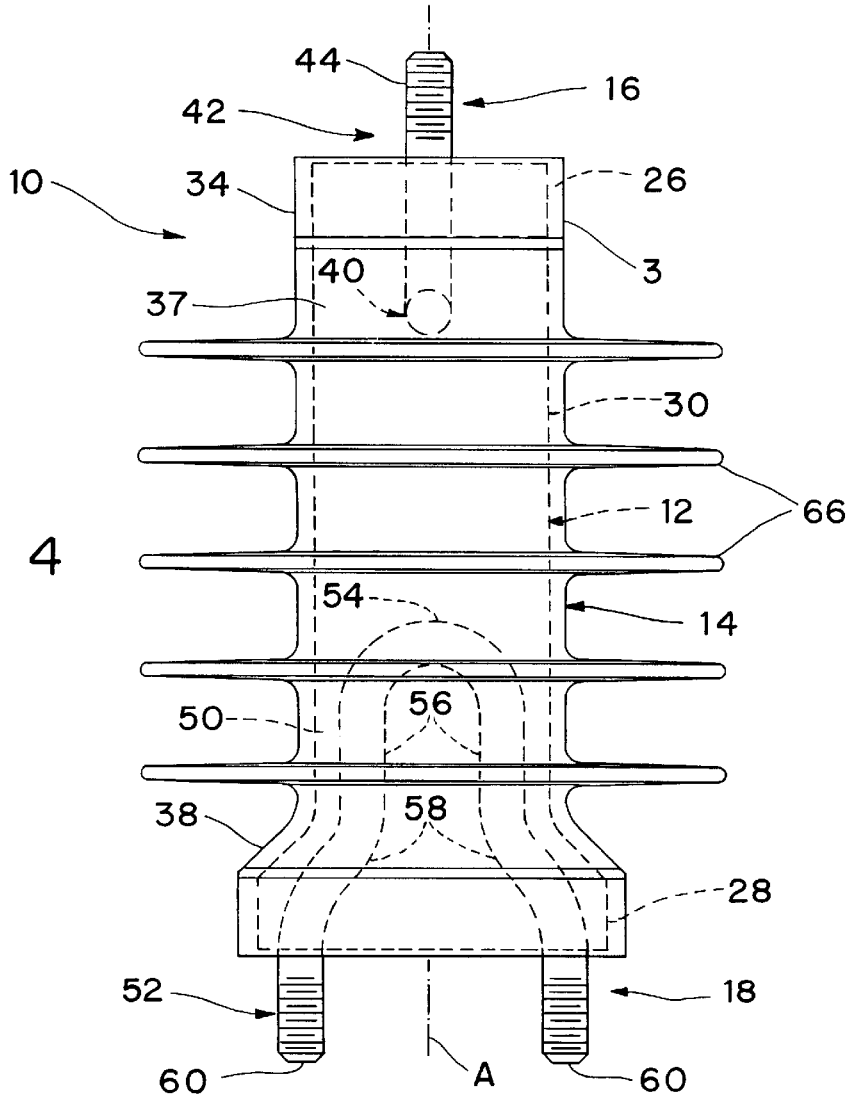
FIG. 4 is a side elevational view of the reinforced electrical insulator illustrated in FIGS. 1–3.

As best seen in FIGS. 1 and 3, first end section 26 has a pair of flat opposed portions 34 and a pair of curved portions 36 with a transition portion 37 tapering from first end section 26 to center section 30. Of course, first end section 26 can have other shapes so long as it has a sufficient width to accommodate first attachment member 16. Second end section 18 is generally circular as seen in bottom plan view with a transition portion 38 tapering between second end section 28 and center section 30. Of course, second end section 28 can have other shapes so long as it has a sufficient width to accommodate second attachment member 18.

Figure 2:
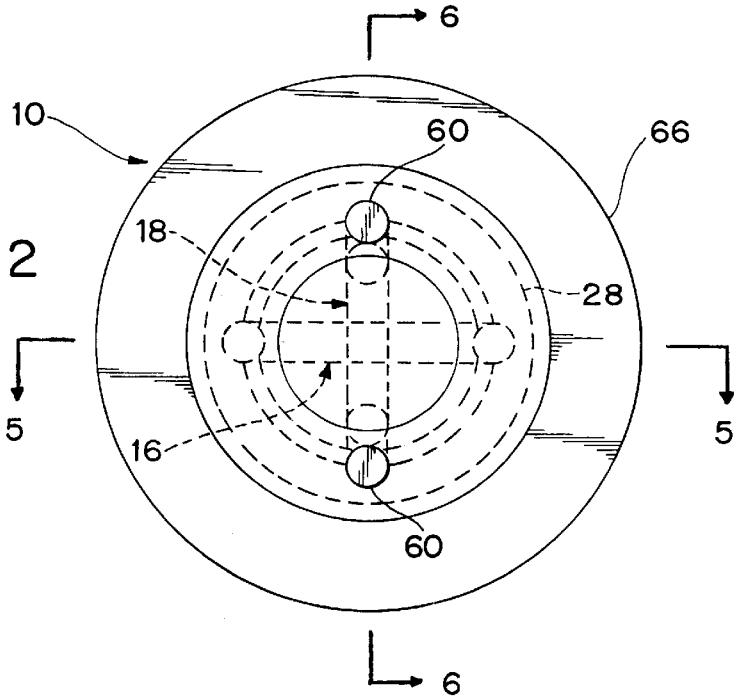
FIG. 2 is a bottom plan view of the reinforced electrical insulator illustrated in FIG. 1.
Figure 7:
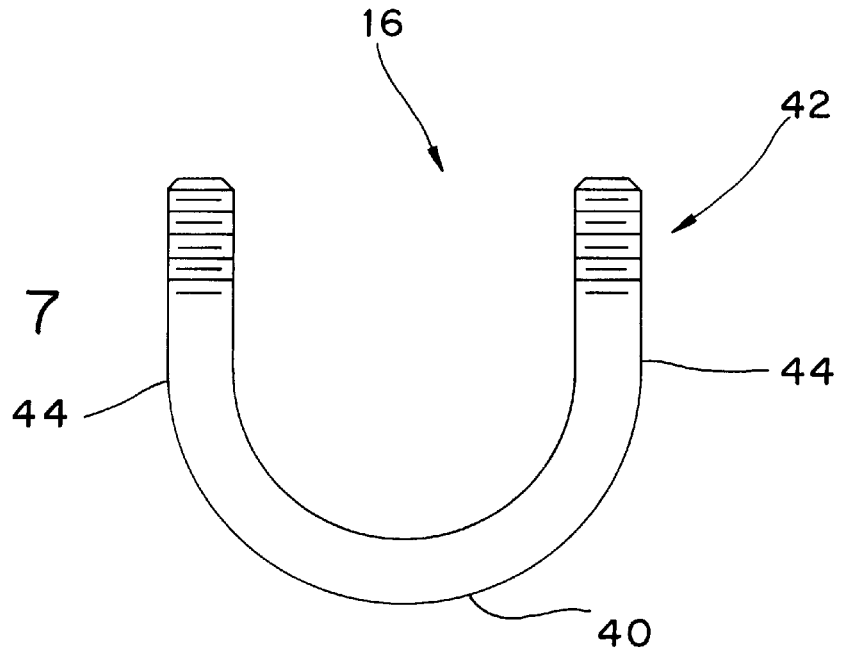
FIG. 7 is a front elevational view of the first or upper attachment member for the reinforced electrical insulator illustrated in FIGS. 1–6.
Figure 8:
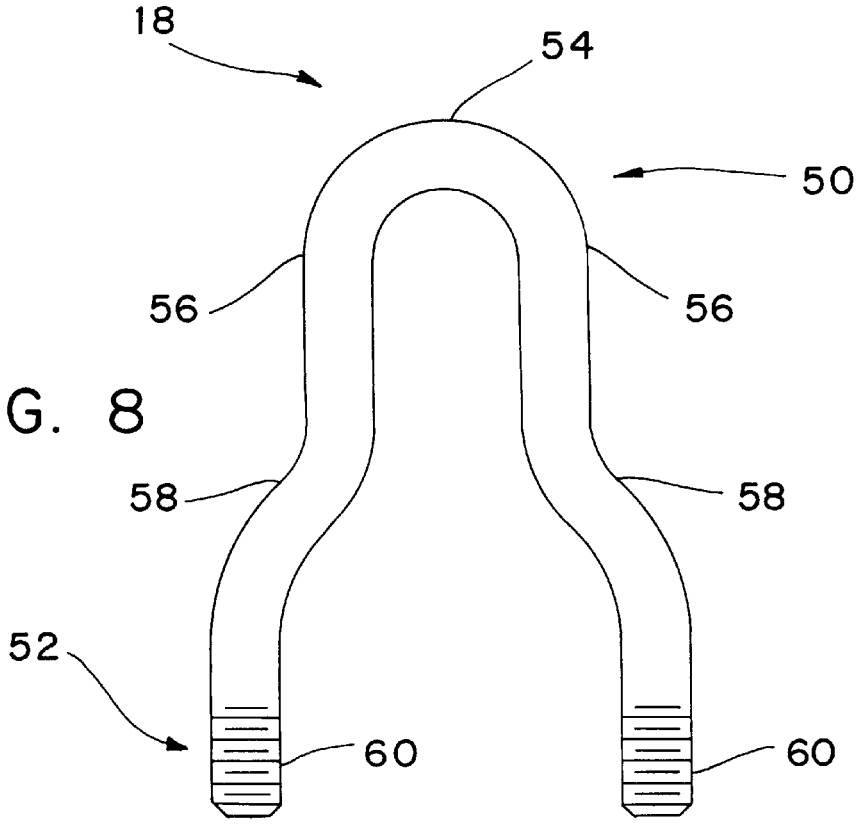
FIG. 8 is a front elevational view of the second or lower attachment member for the reinforced electrical insulator illustrated in FIGS. 1–6.

Attachment members 16 and 18, as best seen in FIGS. 7 and 8, are preferably constructed of a hard, rigid material to increase the strength of core 12. Preferably, first and second attachment members 16 and 18 are constructed of a strong metallic material such as steel. As best seen in FIGS. 2 and 3, attachment members 16 and 18 lie in first and second longitudinally extending planes, respectively, which are substantially perpendicular to each other. In use, an electrical device is coupled to first attachment member 16 such that a cantilever force is applied to insulator 10 in a direction substantially parallel to the plane of first attachment member 16. In other words, this cantilever force is directed substantially perpendicular to the longitudinal plane of second attachment member 18. Accordingly, second attachment member 18 reinforces insulator 10.

Turning now to FIGS. 5 and 7, first or upper attachment member 16 is a substantially U-shaped member, i.e., a U-bolt. First attachment member 16 has an inner portion 40 embedded within first end section 26 of core 12 and an outer portion 42 extending outwardly from core 12. Inner portion 40 of first attachment member 16 is a curved bight portion, while outer portion 42 forms a pair of parallel leg portions 44 with threaded free ends. Bight or inner portion 40 is embedded within first end section 26 of mechanical core 12, while leg portions 44 extend outwardly from first end section 26 to form a pair of threaded posts. The threaded posts of leg portions 44 are adapted threadedly receive a nut (not shown) for attaching an electrical device or cable thereto in a conventional manner. Preferably, the centers of leg portions 44 are spaced apart approximately 2.25 inches or 3.0 inches. As can be seen in FIGS. 1 and 5, the overall maximum width of first attachment member 16 is larger than the overall maximum width or diameter of center section 30.

As best seen in FIGS. 5 and 8, second or lower attachment member 18 has an inner portion 50 embedded within center section 30 of core 12 and an outer portion 52 partially embedded within second end section 28. More specifically, inner portion 50 has a curved bight portion 54 with a pair of parallel leg portions 56 extending from bight portion 54 to form a substantially U-shaped member located within center section 30. Outer portion 52 has a pair of curved portions 58 embedded within second end section 28 of core 12 and a pair of threaded posts 60 extending outwardly from second end section 28. Threaded posts 60 are adapted to receive nuts for attaching insulator 10 to a support member (not shown).

The innermost points of first and second attachment members 16 and 18 are separated from each other to prevent electrical current from flowing therebetween. In particular, the spacing is preferably sufficient to prevent electrical current from passing between attachment members 16 and 18 when subjected to 1000 kilovolts per microsecond. In particular, attachment members 16 and 18 should be separated to pass a steep wave impulse test simulating a lighting strike of 1000 kilovolts per microsecond in accordance with ANSI C 29.11 §7.1.6.2.

In the particular embodiment illustrated, the overall length of insulator 10 is 6.91 inches with first attachment member 16 being embedded approximately 1.50 inches and second attachment member 18 being embedded approximately 3.0 inches. In other words, second attachment member extends approximately twice as deep into mechanical core 12 as first attachment member 16. Moreover, second attachment member 18 extends less than half the overall longitudinal length of mechanical core 12 and preferably extends at least one quarter of the overall axial length of core 12. Preferably, the depth in which second attachment member 18 is embedded within core 12 is determined by a stress calculation in which insulator 10 is placed under stress such that the point of maximum stress is determined when a cantilever force is applied substantially perpendicular to longitudinal axis A at the free end or first end section 26 of insulator 10.

In this embodiment, sheath 14 is an elastomeric member and has five annular flanges or weathersheds 66 extending outwardly therefrom. Of course, fewer or more weathersheds 66 can be utilized as needed and/or desired. For example, the insulator can be six inches to ten inches in height with four to eight weathersheds depending on the height of the insulator. Sheath 14 preferably follows the contour of mechanical core 12 such that sheath 14 has a substantially similar contour or profile over its outer surface, except for the outwardly extending weathersheds 66. The weathersheds 66 are designed to elongate the electrical path along the surface of insulator 10 for enhancing electrical characteristics of insulator 10. The maximum diameter or width of weathersheds 66 is preferably larger than the maximum diameters or widths of end sections 26 and 28.

Dielectric sheath 14 is coated over mechanical core 12 using a conventional method such as compression, injection or transfer. Alternatively, additional methods of applying sheath 14 to mechanical core 12 includes dipping, painting or spraying mechanical core 12 with a weather resistant, ultra-violet resistant and electrical discharge resistant material such as RTV. In most applications, mechanical core 12 will be substantially completely covered by dielectric sheath 14 for sealing it from the weather. In the illustrated embodiment, a combination of a molded sheath 14 and an RTV is used to enclose mechanical core 12. In particular, RTV is used to seal the metal ends of attachment members 16 and 18. Of course, molded sheath 14 can be used to completely encase mechanical core 12. Dielectric sheath 14 allows mechanical core 12 to be constructed of a variety of materials which would not normally be used in the outdoor environment. Of course, it will be apparent to those skilled in the art from this disclosure that mechanical core 12 could be constructed such that weathersheds 66 are formed as a one-piece, unitary member of mechanical core 12 so as to eliminate sheath 14. In other words, weathersheds 66 would be part of molded core 12.

Construction and Installation

As mentioned above, insulator 10 is constructed utilizing conventional molding or machining methods. For example, in constructing insulator 10 in accordance with the present invention, mechanical core 12 can be first molded by either compression, injection or transfer molding such that attachment members 16 and 18 are embedded within core 12. Then, the mechanical core 12 is covered with sheath 14 using one of the conventional molding methods such as compression, injection or transfer to apply sheath 14 to core 12 for completing construction of insulator 10.

Now, insulator 10 can be coupled to a support of a utility pole or tower (not shown) in a conventional manner. Specifically, the lower attachment member 18 is bolted to the support of the utility pole or tower. Next, an electrical device or conductor is attached to insulator 10 via upper attachment member 16.

Second Embodiment

Referring now to FIG. 9, an insulator 110 in accordance with a second embodiment of the present invention is illustrated. Insulator 110 is substantially identical to insulator 10, discussed above, except that the second or lower attachment member 118 of the second embodiment has been changed. Accordingly, insulator 110 will not be discussed or illustrated in detail herein. Rather, it will be apparent to those skilled in the art from this disclosure that the description and drawings of the first embodiment are applicable to this second embodiment except as noted herein.

Similar to the first embodiment, insulator 110 includes an elongated load sustaining mechanical core 112 with a dielectric sheath 114 overlying mechanical core 112 to protect mechanical core 112 from weather, ultra-violet rays and electrical surface discharges. Embedded in each end of insulator 110 are first and second attachment members 116 and 118. Preferably, first and second attachment members 116 and 118 are constructed of strong metallic material such as steel. Similar to the first embodiment, attachment members 116 and 118 preferably lie in first and second longitudinally extending planes, respectively, which are substantially perpendicular to each other. In use, an electrical device is coupled to first attachment member 116 such that a cantilever force is typically applied to the upper end of insulator 110 in a direction substantially parallel to the plane of the first attachment member. In other words, this cantilever force is directed substantially perpendicular to the longitudinal plane of second attachment member 118. Accordingly, second attachment member 118 reinforces insulator 110 to prevent insulator 110 from breaking when a cantilever force is applied thereto.

Second attachment member 118 is constructed of two J-shaped bolts which is similar in construction to the one-piece attachment member of the first embodiment, except that the bight portion is discontinuous. More specifically, each bolt of second attachment member 118 has its inner portion 150 embedded within center section 130 of core 112 and a pair of outer portions 152 partially embedded within second end section 128. Each of the inner portions 150 has an inwardly extending end section 154 and a leg section 156 extending substantially perpendicular to end sections 154 such that inner portions 150 of each of the J-shaped bolts forms essentially a substantially U-shaped member within center section 130 of mechanical core 112. Outer portions 152 each has a curved portion 158 embedded within second end section 128 of core 112 and a pair of threaded posts 160 extending outwardly from second end section 128 of mechanical core 112. The threaded posts 160 are adapted to receive nuts for attaching insulator 110 to a support member (not shown). Of course, threaded posts 160 can be eliminated and replaced with internally threaded bores as in the third embodiment described below.

The innermost points of first and second attachment members 116 and 118 are spaced apart from each other to prevent electrical current from flowing therebetween. In particular, the spacing is preferably sufficient to prevent electrical current from passing between attachment members 116 and 118 when subjected to 1000 kilovolts per microsecond.

Third Embodiment

Referring now to FIG. 10, an insulator 210 in accordance with a third embodiment of the present invention is illustrated. Insulator 210 is substantially identical to insulator 10, discussed above, except that the second or lower attachment member 218 has been changed in the third embodiment. Accordingly, insulator 210 will not be discussed or illustrated in detail herein. Rather, it will be apparent to those skilled in the art from this disclosure that the description and drawings of the first embodiment are applicable to this third embodiment except as noted herein.

Similar to the first embodiment, insulator 210 includes an elongated load sustaining mechanical core 212 with a dielectric sheath 214 overlying mechanical core 212 to protect mechanical core 212 from weather, ultra-violet rays and electrical surface discharges. Embedded in each end of insulator 210 are first and second attachment members 216 and 218. Preferably, first and second attachment members 216 and 218 are constructed of strong metallic material such as steel. Similar to the first embodiment, attachment members 216 and 218 preferably lie in first and second longitudinally extending planes, respectively, which are substantially perpendicular to each other. In use, an electrical device is coupled to first attachment member 216 such that a cantilever force is typically applied to the upper end of insulator 210 in a direction substantially parallel to the plane of the first attachment member. In other words, this cantilever force is directed substantially perpendicular to the longitudinal plane of second attachment member 218. Accordingly, second attachment member 218 reinforces insulator 210.

Second attachment member 218 is a U-shaped member which basically is similar in construction to the first embodiment, except that bolts (not shown) are used to couple insulator 210 to a support. More specifically, second attachment member 218 has a U-shaped inner portion 250 embedded within center section 230 of core 212 and a pair of outer portions 252 embedded within second end section 228. Inner portion 250 has bight portion 254 and a pair of leg portions 256 extending from bight portion 254 such that a substantially U-shaped member is formed within center section 230 of mechanical core 212. Outer portions 252 each has a curved section 258 embedded within second end section 228 of core 212 and a pair of straight sections with internally threaded bores 260 adapted to receive bolts for attaching insulator 210 to a support (not shown).

The innermost points of first and second attachment members 216 and 218 are spaced apart from each other to prevent electrical current from flowing therebetween. In particular, the spacing is preferably sufficient to prevent electrical current from passing between attachment members 216 and 218 when subjected to 1000 kilovolts per microsecond.

While several embodiments have been chosen to illustrate the present invention, it will be apparent to those skilled in the art from this disclosure that various changes and modifications can be made herein without departing from the scope of the invention as defined in the appended claims.

What is claimed is:

1. A reinforced electrical insulator, comprising:

an elongated core member constructed of a rigid, dielectric material, said core member having a first end section, a second end section, and a center section with a first maximum width located between said first and second end sections and extending longitudinally along a longitudinal axis, said first and second end sections having second and third maximum widths which are larger than said first maximum width of said center section;

a plurality of weathersheds extending outwardly from said center section of said core member in a substantially radial direction relative to said longitudinal axis;

a first attachment member having a first inner portion embedded within said first end section of said core member and a first outer portion extending outwardly from said first end section of said core member; and a second attachment member having a second inner portion embedded within said center section of said core member and a second outer portion coupled to said second inner portion and embedded within said second end section of said core member, said second inner portion having a fourth maximum width, said second outer portion having a fifth maximum width which is greater than said first maximum width of said center section.

2. A reinforced electrical insulator according to claim 1, wherein said second outer portion having first and second posts extending outwardly from said second end section of said core member with said first and second posts having their centers spaced apart by a distance which is greater than said fourth maximum width of said second inner portion.

3. A reinforced electrical insulator according to claim 2, wherein said first and second posts have threaded free ends.

4. A reinforced electrical insulator according to claim 3, wherein said second inner portion is a substantially U-shaped portion with a curved bight portion and first and second inner leg portions extending from said bight portion.

5. A reinforced electrical insulator according to claim 4, wherein said first attachment member is substantially U-shaped.

6. A reinforced electrical insulator according to claim 5, wherein said first attachment member lies in a first longitudinally extending plane and said second attachment member lies in a second longitudinally extending plane which is substantially perpendicular to said first plane.

7. A reinforced electrical insulator according to claim 6, wherein said first outer portion of said first attachment member includes a pair of additional threaded posts.

8. A reinforced electrical insulator according to claim 7, further comprising a dielectric sheath overlying said core member and forming said weathersheds.

9. A reinforced electrical insulator according to claim 8, wherein said core member is constructed of a plastic polymer material.

10. A reinforced electrical insulator according to claim 9, wherein said sheath is constructed of an elastomeric material.

11. A reinforced electrical insulator according to claim 10, wherein said first and second attachment members have their innermost points spaced apart to prevent electrical current from flowing therebetween when subjected to 1000 kilovolts per micro second.

12. A reinforced electrical insulator according to claim 1, wherein said first and second attachment members have their innermost points spaced apart to prevent electrical current from flowing therebetween when subjected to 1000 kilovolts per micro second.

13. A reinforced electrical insulator according to claim 1, wherein said second attachment member has a longitudinal length within said core member which is less than half of an overall longitudinal length of said core member.

14. A reinforced electrical insulator according to claim 13, wherein said longitudinal length of said second attachment member extends longitudinally within said core member at least one-quarter the overall longitudinal length of said core member.

15. A reinforced electrical insulator according to claim 14, wherein said first outer portion of said first attachment member includes a pair of threaded posts.

16. A reinforced electrical insulator according to claim 14, wherein said first outer portion of said first attachment member includes first and second posts having threaded free ends.

17. A reinforced electrical insulator according to claim 16, wherein said first and second attachment members have their innermost points spaced apart to prevent electrical current from flowing therebetween when subjected to 1000 kilovolts per micro second.

18. A reinforced electrical insulator according to claim 17, wherein said second inner portion is a substantially U-shaped portion with a curved bight portion and first and second inner leg portions extending from said bight portion.

19. A reinforced electrical insulator according to claim 18, wherein said first attachment member is substantially U-shaped.

20. A reinforced electrical insulator according to claim 19, wherein said first attachment member lies in a first longitudinally extending plane and said second attachment member lies in a second longitudinally extending plane which is substantially perpendicular to said first plane.

21. A reinforced electrical insulator according to claim 20, wherein said core member is constructed of a plastic polymer material; and said sheath is constructed of an elastomeric material.

22. A reinforced electrical insulator according to claim 1, wherein said second attachment member is a one-piece, unitary member.

23. A reinforced electrical insulator according to claim 1, wherein said second attachment member is constructed of two separated elements.

24. A reinforced electrical insulator according to claim 1, wherein said second outer portion has a pair of internally threaded bores.

25. A reinforced electrical insulator according to claim 24, wherein said internally threaded bores have center axes which are spaced apart by a distance which is greater than said fourth maximum width of said second inner portion.

26. A reinforced electrical insulator according to claim 24, wherein said second inner portion is a substantially U-shaped portion with a curved bight portion and first and second inner leg portions extending from said bight portion.

27. A reinforced electrical insulator according to claim 26, wherein said first attachment member is substantially U-shaped.

28. A reinforced electrical insulator according to claim 27, wherein said first attachment member lies in a first longitudinally extending plane and said second attachment member lies in a second longitudinally extending plane which is substantially perpendicular to said first plane.

29. A reinforced electrical insulator according to claim 1, wherein said first attachment member lies in a first longitudinally extending plane and said second attachment member lies in a second longitudinally extending plane which is substantially perpendicular to said first plane.

30. A reinforced electrical insulator according to claim 29, wherein said first and second attachment members have their innermost points spaced apart to prevent electrical current from flowing therebetween when subjected to 1000 kilovolts per micro second.

* * * * *